US007094137B2

(12) United States Patent
Ueno

(10) Patent No.: US 7,094,137 B2
(45) Date of Patent: Aug. 22, 2006

(54) POLISHING DEVICE

(75) Inventor: Makoto Ueno, Tagajo (JP)

(73) Assignee: Tateo Uegaki, Sendai (JP)

( * ) Notice: Subject to any disclaimer, the term of this patent is extended or adjusted under 35 U.S.C. 154(b) by 268 days.

(21) Appl. No.: 10/381,526

(22) PCT Filed: Sep. 28, 2001

(86) PCT No.: PCT/JP01/08583

§ 371 (c)(1),
(2), (4) Date: Mar. 26, 2003

(87) PCT Pub. No.: WO02/26446

PCT Pub. Date: Apr. 4, 2002

(65) Prior Publication Data

US 2004/0018810 A1 Jan. 29, 2004

(30) Foreign Application Priority Data

Sep. 28, 2000 (JP) ..... 2000-297353

(51) Int. Cl.
*B24B 1/00* (2006.01)

(52) U.S. Cl. ..... 451/350; 451/514; 451/523; 451/524; 451/525; 451/526; 451/539

(58) Field of Classification Search ..... 451/350, 451/514, 523, 524, 525, 526, 539
See application file for complete search history.

(56) References Cited

U.S. PATENT DOCUMENTS 2,235,446 A 3/1941 Birger et al.
4,643,263 A 2/1987 Karden
6,053,805 A * 4/2000 Sanchez ..... 451/456
6,406,365 B1 * 6/2002 Ueno ..... 451/523
6,634,937 B1 * 10/2003 Edwards et al. ..... 451/502
6,641,469 B1 * 11/2003 Deshler ..... 451/514
6,659,852 B1 * 12/2003 Wettstein et al. ..... 451/557

FOREIGN PATENT DOCUMENTS

JP 03-59158 * 6/1991
JP 05-67456 9/1993
JP 09-225841 9/1997
JP 2000-343441 12/2000

* cited by examiner

*Primary Examiner*—Joseph J. Hail, III
*Assistant Examiner*—Shantese McDonald
(74) *Attorney, Agent, or Firm*—Burr & Brown

(57) ABSTRACT

A polishing device capable of polishing a repaired surface in a specified shape, comprising a polishing panel body holding a polishing material on a surface opposed to the repaired surface and polishing the repaired surface in the specified shape with the polishing material and a holding part installed on the polishing panel body and held when the polishing panel body is operated, wherein the holding part is installed on the polishing panel body rotatably about an axis set on the polishing panel body, whereby a controllability can be improved, the labor of a worker can be reduced, and the disturbance of smoothness on the repaired surface and the premature wear of sand paper can be suppressed.

13 Claims, 17 Drawing Sheets

POLISHING DEVICE

TECHNICAL FIELD

The present invention relates to a polishing device for polishing a surface to be repaired into a predetermined shape.

BACKGROUND ART

When the coated surface of a vehicle has been flawed or dented and needs repairing, a process is performed in which the primer, surfacer, and paint with which the panel surface (steel plate) has been coated are peeled off by polishing. Further, a process is performed in which the damaged portion is filled with putty etc. and in which the putty surface and the body surface are polished so as to make them flush with each other.

Usually, in these processes, the operation is conducted by using a polishing device which is, as shown in FIGS. 21 and 22, equipped with a polishing panel body 100 having a sandpaper 101 constituting the polishing material glued to its surface opposed to the surface to be repaired, and a holding part 102, 103 fixed to the polishing panel body 100.

The holding part, which is formed in a variety of forms according to the use, e.g., for both hands or one hand, is roughly classified in the following two patterns: a first pattern in which it is simply formed as a plate as shown in FIG. 21, and a second pattern in which it is equipped with a bar-shaped grip. In both patterns, the holding part is firmly fixed to the polishing panel body 100 so as to protrude upright from the center of the polishing panel body 100.

The polishing operation using the polishing device is performed not only on a flat portion which allows the operation to be conducted in an easy position, but also on a portion having a curved surface and a portion requiring operation in an uneasy position, e.g., a portion around a tire house and an inwardly bent portion at the lower end of a door. Thus, the operator has to appropriately change the operating direction of the polishing device or the way he holds the holding part.

However, the conventional polishing device, in which the holding part and the polishing panel body are fixed to each other, can only be held at a fixed holding angle. In other words, the degree of operational freedom of the polishing device is rather low. Conducting operation while holding the holding part in an irregular fashion leads to a pain and fatigue in the hand, resulting in a substantial reduction in the general operational efficiency.

Further, when the conventional polishing device is being used, the plate-shaped holding part protruding upright from the polishing panel body is held by hand, so that the external force (pressure) transmitted from the holding part to the surface to be polished is transmitted to a point considerably spaced apart from the surface to be polished. Thus, polishing is performed with the polishing device being in an unstable state, so that the smoothness of the surface to be repaired (the surface to be polished) is disturbed or the sandpaper undergoes unsymmetrical wear, which can not only impair the operability of the polishing device, but also adversely affect the vehicle repairing operation itself.

SUMMARY OF THE INVENTION

It is an object of the present invention to provide a polishing device which is superior in operability and which can contribute to reducing the labor of the operator. Further, the present invention aims to provide a polishing device capable of restraining disturbance of the smoothness of the surface to be repaired, premature wear of the sandpaper, etc.

The polishing device of the present invention includes a polishing panel body which holds a polishing material on its surface opposed to the surface to be repaired and which polishes the surface to be repaired into a predetermined shape with the polishing material, and a holding part which is provided on the polishing panel body and which is held by hand when the polishing panel body is to be operated. The holding part is provided on the polishing panel body so as to be rotatable around a predetermined axis set on the polishing panel body.

Thus, in the polishing device of the present invention, the mounting angle of the holding part with respect to the polishing panel body can be arbitrarily changed. Accordingly, the operator can change the holding angle of the holding part to a desired position according to the shape of the surface to be repaired, so that he can easily polish the surface to be repaired without having to hold the holding part in an irregular fashion. Note that the predetermined axis implies both an axis extending from the polishing panel body and an axis extending from the holding part.

It is also possible for the holding part to be rotatably provided in a plane parallel to the panel surface of the polishing panel body. That is, the polishing device of the present invention allows the mounting angle of the holding part to be changed two-dimensionally parallel to the panel surface of the polishing panel body.

Further, in the present invention, it is also possible to adopt a construction in which there is provided a fixing means for fixing the holding part at a predetermined rotating position with respect to the polishing panel body. That is, the operator can fix the holding part at a desired position with respect to the polishing panel body. As a result, even in the case of a heavy operation, the mounting angle of the holding part is not changed. Thus, this construction helps to further improve the operability of the polishing device.

It is desirable for the fixing means to fix the polishing panel body and the holding part to each other at a position spaced apart from the rotation center of the holding part. In this case, it is possible to enhance the fixing strength for the polishing panel body and the holding part as compared with the case in which the polishing panel body and the holding part are fixed together at the rotation center of the holding part.

Further, the fixing means may comprise a lock member which can freely move to a lock position where the polishing panel body and the holding part are normally fixed to each other and a lock releasing position where the fixation of the polishing panel body and the holding part is canceled to permit rotation of the holding part. That is, it is possible to adopt as the fixing means a lock mechanism which automatically locks when rotation of the holding part is not required. Thus, the operator can easily change the mounting angle of the holding part with respect to the polishing panel body.

Further, the holding part may comprise a swollen portion whose surface comes into contact with the palm of the hand during operation of the device, and finger rest recesses arranged on both sides of the swollen portion and held between fingers during the operation of the device. That is, a configuration is adopted which provides the most stable holding state when the holding part is held so as to be wrapped in the entire hand. Further, due to the finger rest recesses arranged on both sides of the swollen portion, the palm of the hand is not shifted from the swollen portion even in the case of a heavy polishing, making it possible to maintain a stable holding state. Thus, a uniform pressure is applied to the surface to be polished. Further, the external force (pressure) from the holding part is transmitted to the surface to be polished at a point near the same.

It is desirable that the connecting portions between the swollen portion and the finger rest recesses be formed as continuous curved surfaces. That is, the portions in contact with the hand are formed as continuous curved surfaces conformable to the hand.

Further, the swollen portion may be provided at a position spaced apart from the center of the polishing panel body. In this construction, due to the deviation of the swollen portion from the center of the polishing panel body, it is possible to apply a uniform pressure to the polishing panel body as a whole by the entire hand.

Further, the holding part may be equipped with a plurality of swollen portions, at least two of the plurality of swollen portions are arranged in a straight line passing the predetermined axis so as to be symmetrical with respect to the predetermined axis. That is, due to the swollen portions arranged symmetrically with respect to the predetermined axis, the polishing device can be suitably held by both hands.

Further, it is also possible for the holding part to be composed of a plurality of members, each of which is equipped with a swollen portion and rotatable with respect to the predetermined axis. That is, a holding part for the holding by the right hand and a holding part for the holding by the left hand are separately provided, and these holding parts are connected so as to be rotatable with respect to the predetermined axis. Thus, in this construction, the holding angle for the right hand and that for the left hand can be set individually.

Further, the polishing panel body may comprise a base panel portion retaining a polishing material on its surface opposed to the surface to be repaired, a movable base panel portion bendably hinged on an end portion of the base panel portion and retaining a polishing material on its surface opposed to the surface to be repaired, and an urging means for urging the surface of the movable base panel portion so as to make it flush with the surface of the base panel portion. Thus, in this construction, the end portion of the polishing surface for polishing the surface to be repaired is formed so as to be bendable. As a result, even when polishing is performed by using the end portion of the polishing surface, the polishing surface comes into contact with the surface to be repaired not as a line but as a plane, whereby it is possible to restrain a polishing failure such as overpolishing.

Thus, according to the present invention, polishing operation can be performed while holding the polishing device at a reasonable holding angle, so that the operator is spared a pain and fatigue in the hand. Further, due to the adoption of a holding part which provides the most stable holding state when held so as to be wrapped in the entire hand, the polishing panel body is improved in terms of stability. In this way, the present invention can provide a polishing device which is superior in operability and which can contribute to a reduction in the labor of the operator. Further, it is possible to provide a polishing device also capable of restraining disturbance of the smoothness of the surface to be repaired, premature wear of the sandpaper, etc.

The axle serving as the rotation center of the holding part may consist of an imaginary axis. That is, when a mechanism such as an arcuate guide rail for rotating the holding part relative to the polishing panel main body is provided in the connecting portion between the polishing panel body and the holding part, there is no need to provide an actual axle at the rotation center.

DETAILED DESCRIPTION OF THE INVENTION

The polishing device of the present invention will now be described in detail with reference to the drawings.

FIRST EMBODIMENT

First, a one-hand polishing device according to a preferred embodiment of the present invention, which is to be held by one hand when used, will be described.

Figure 1:
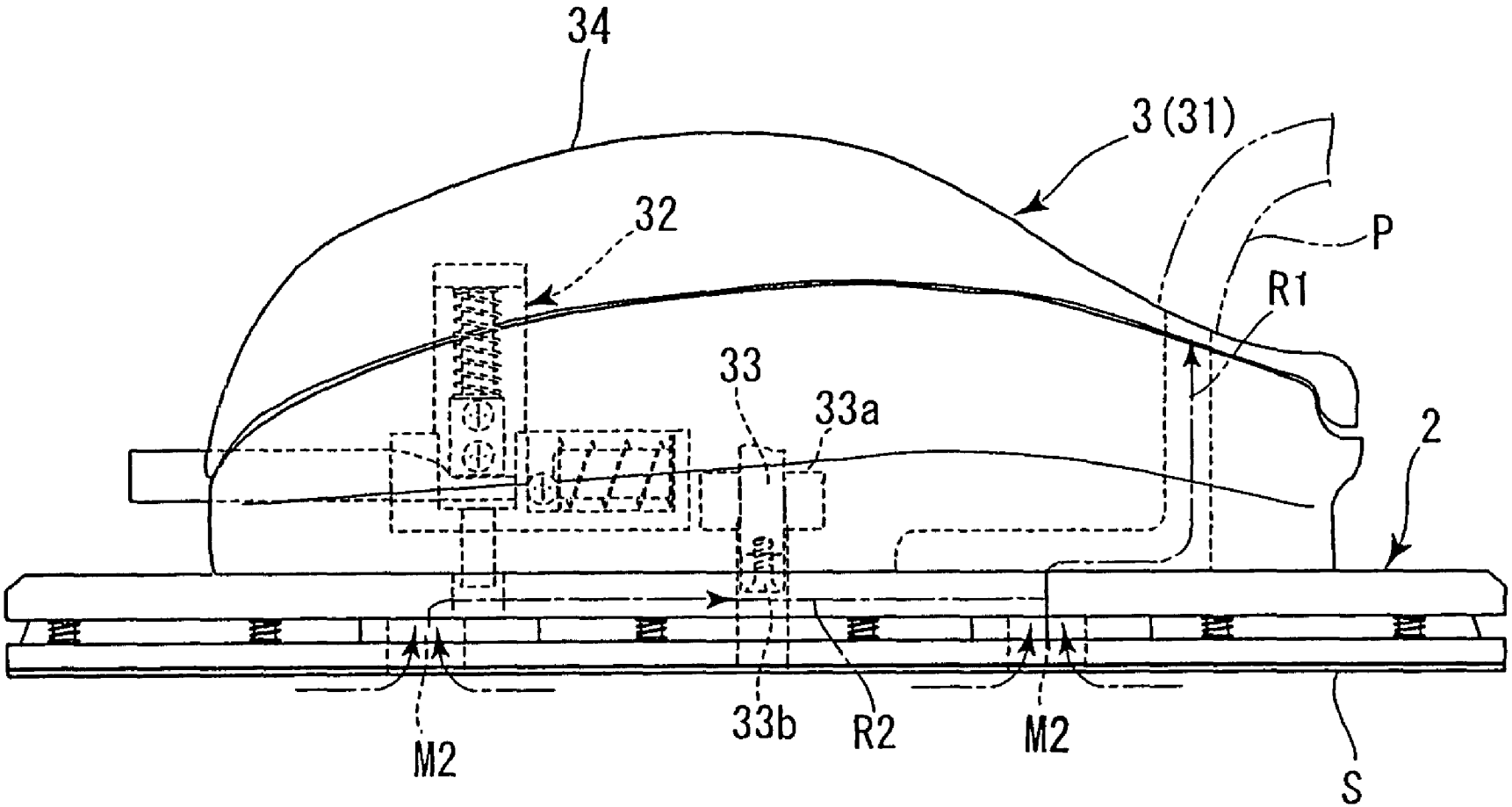
FIG. 1 is a side view of a one-hand polishing device according to a first embodiment of the present invention.
Figure 2:
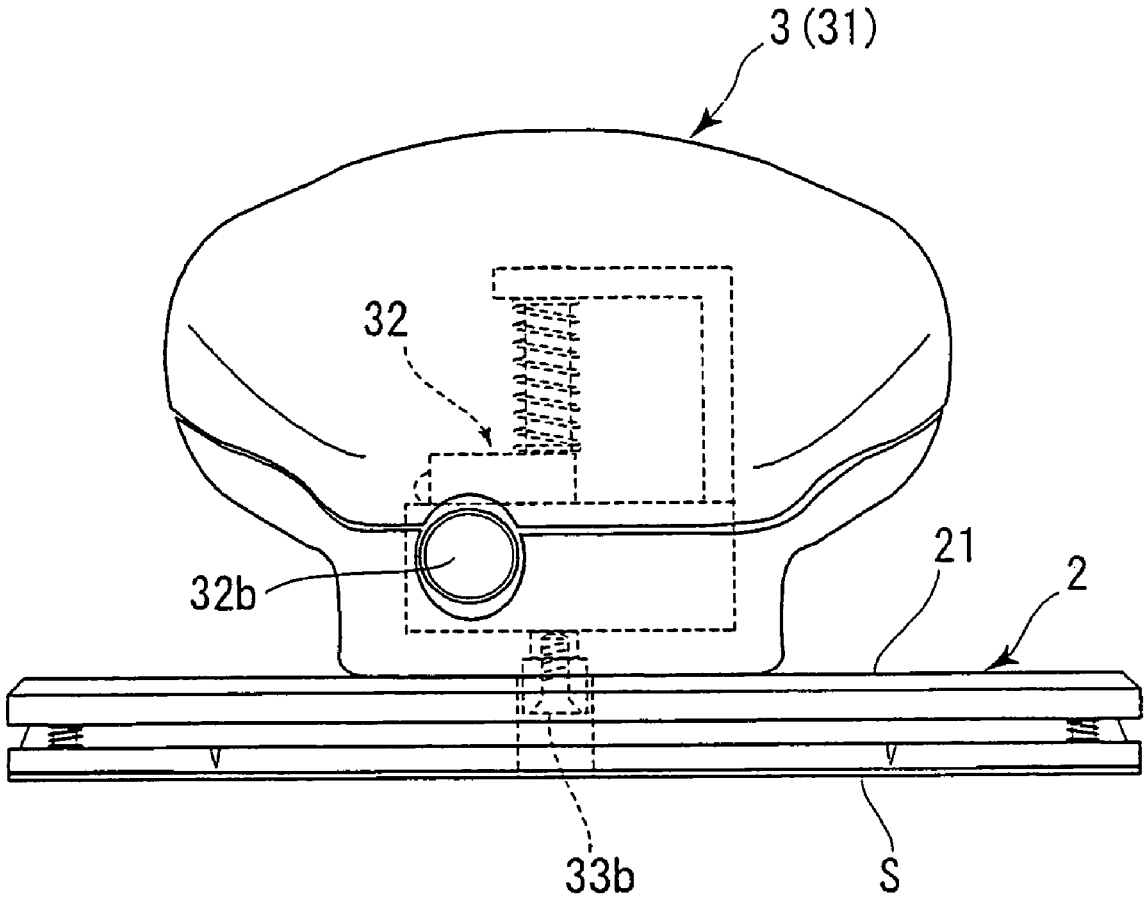
FIG. 2 is a front view of the one-hand polishing device of the first embodiment of the present invention.
Figure 3:
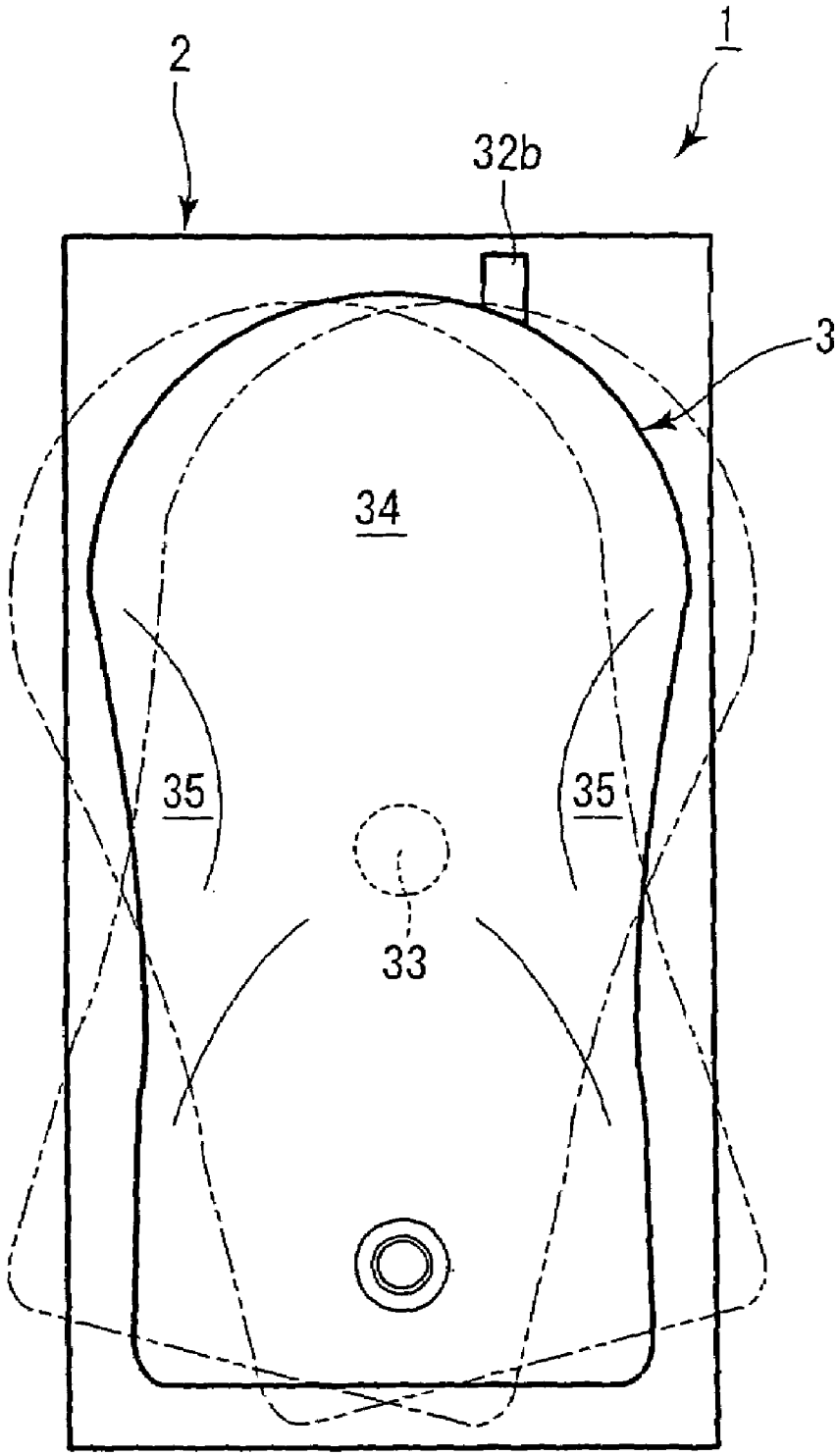
FIG. 3 is a plan view of the one-hand polishing device of the first embodiment of the present invention.

As shown in FIG. 1, a one-hand polishing device 1 according to the present invention includes a polishing panel body 2 having a sandpaper S serving as a polishing material glued to its surface opposed to a surface to be repaired, a holding part 3 provided on the polishing panel body 2 so as to be rotatable around a predetermined axle 33 provided on the polishing panel body 2, and a lock mechanism 32 for fixing the holding part 3 at a predetermined rotating position with respect to the polishing panel body 2.

Figure 4:
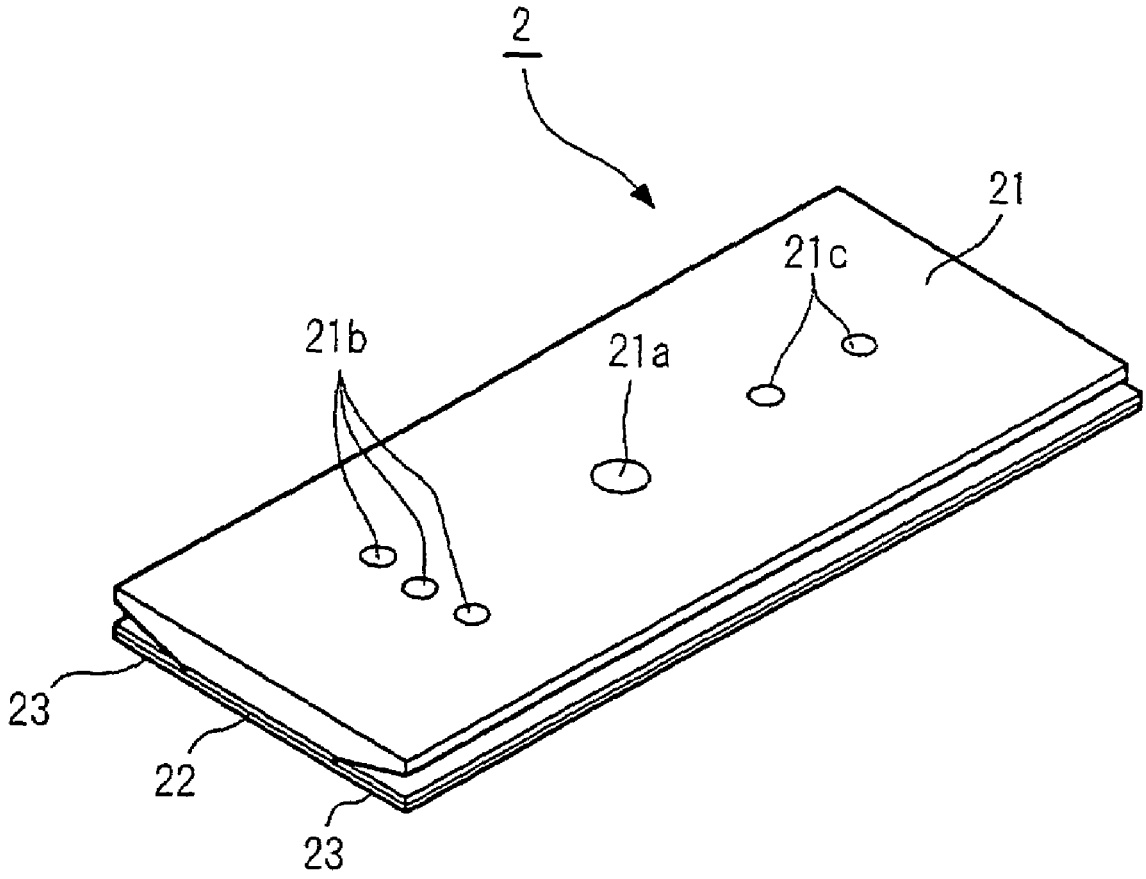
FIG. 4 is a perspective view of the polishing panel body of a polishing device according to the present invention.
Figure 5:
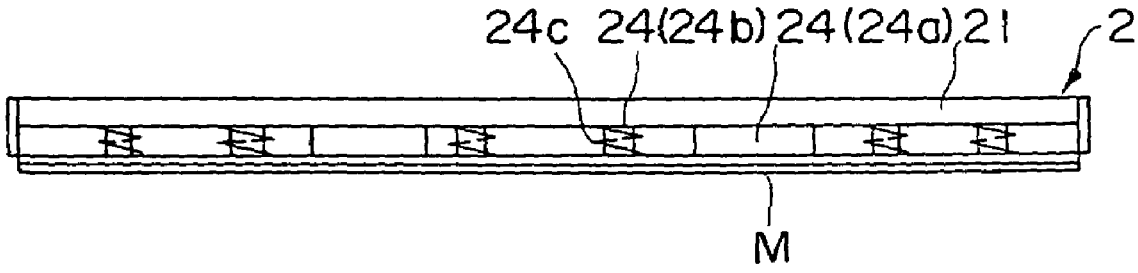
FIG. 5 is a side view of the polishing panel body of the polishing device of the present invention.
Figure 6:
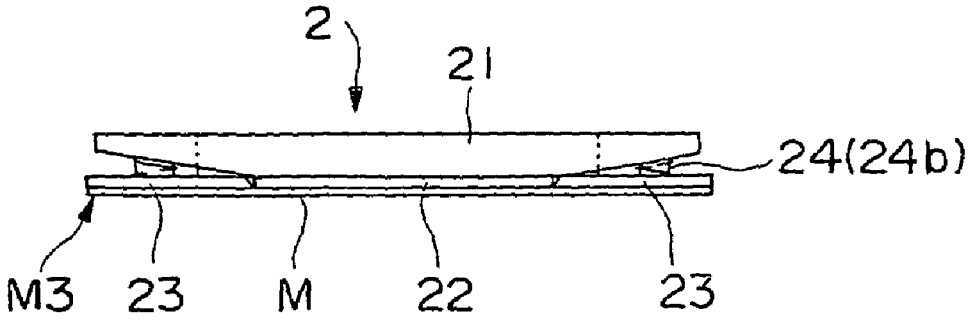
FIG. 6 is a front view of the polishing panel body of the polishing device of the present invention.

As shown in FIG. 4, the polishing panel body 2 includes a retaining panel 21 serving as the mounting portion for the holding part 3, a base panel portion 22 arranged under the retaining panel 21 and detachably retaining the sandpaper S on the surface opposed to the surface to be repaired (the surface to be polished) (not shown), movable base panel portions 23 bendably hinged on end portions 22*a* of the base panel portion 22 and detachably retaining the sandpaper S on the surfaces opposed to the surface to be repaired, elastic members 24 arranged on the lower surface side of the retaining panel 21 and supporting the base panel portion 22 and the movable base panel portions 23 in the same plane, and a dust suction passage R for guiding dust generated during polishing to a dust suction device (not shown) provided separately from the polishing device.

Here, the lower surface side of the retaining panel 21 implies the surface opposed to the surface to be repaired when the polishing device 1 is being used. Further, in the following description, the terms "lower surface" and "lower side" imply the surface and the side opposed to the surface to be repaired unless otherwise specified. Further, in some places of the following description, the surfaces of the base panel portion 22 and the movable base panel portions 23 opposed to the surface to be repaired will be simply referred to as the polishing surfaces M.

The retaining panel 21 is formed of a rectangular aluminum plate, and has at its center a holding part support hole 21*a* used when the holding part 3 is rotatably mounted to the retaining panel 21. At positions spaced apart from the holding part support hole 21*a* and in the same radius of curvature whose center is the holding part support hole 21*a*, there are formed a plurality of lock holes 21*b* used when the holding part 3 is fixed at a desired rotating angle with respect to the retaining panel 21. Further, in the center line extending in the longitudinal direction of the retaining panel 21, there are formed dust collection holes 21*c* for guiding dust (polishing dust) generated during polishing to the dust suction device. The holding part support hole 21*a*, the lock holes 21*b*, and the dust collection holes 21*c* will be described in detail below together with the holding part 3.

Figure 7:
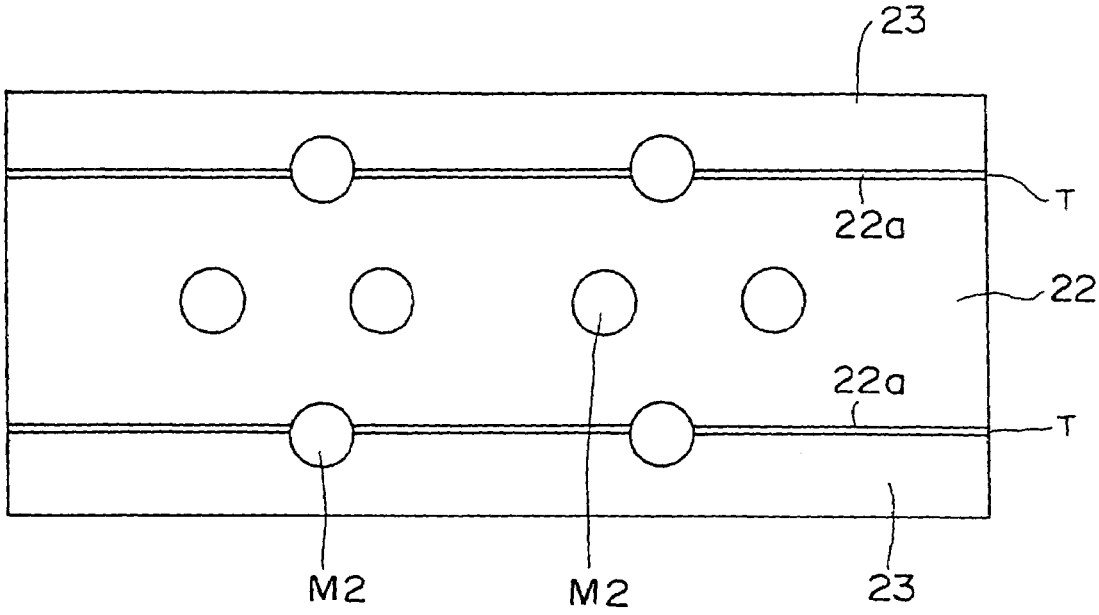
FIG. 7 is a plan view showing how a base panel portion and a movable base panel portion are connected together in a polishing device according to the present invention.
Figure 8:
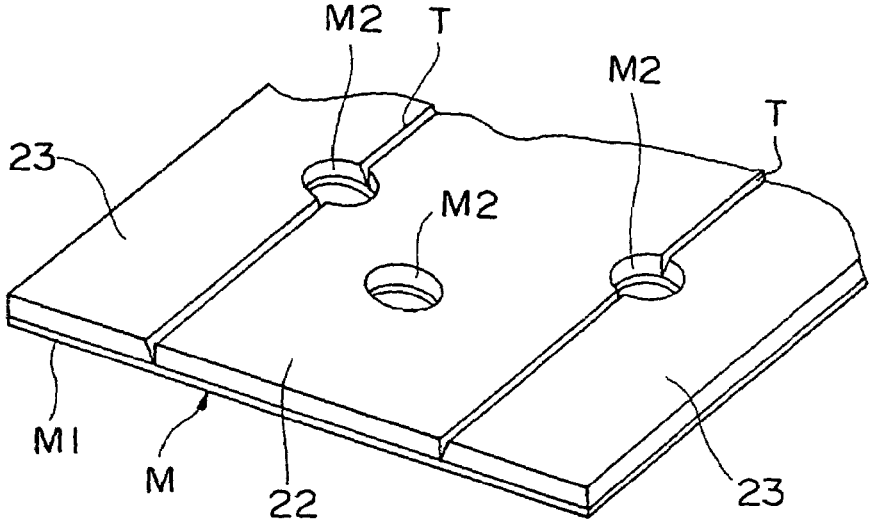
FIG. 8 is a perspective view showing how a base panel portion and a movable base panel portion are connected together in a polishing device according to the present invention.
Figure 9:
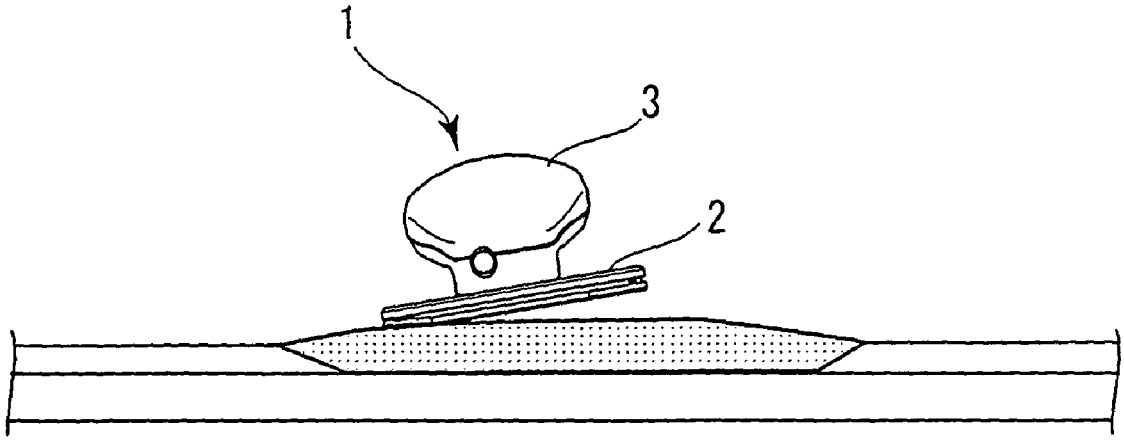
FIG. 9 is a diagram showing how polishing is performed using a polishing surface end portion.
Figure 10:
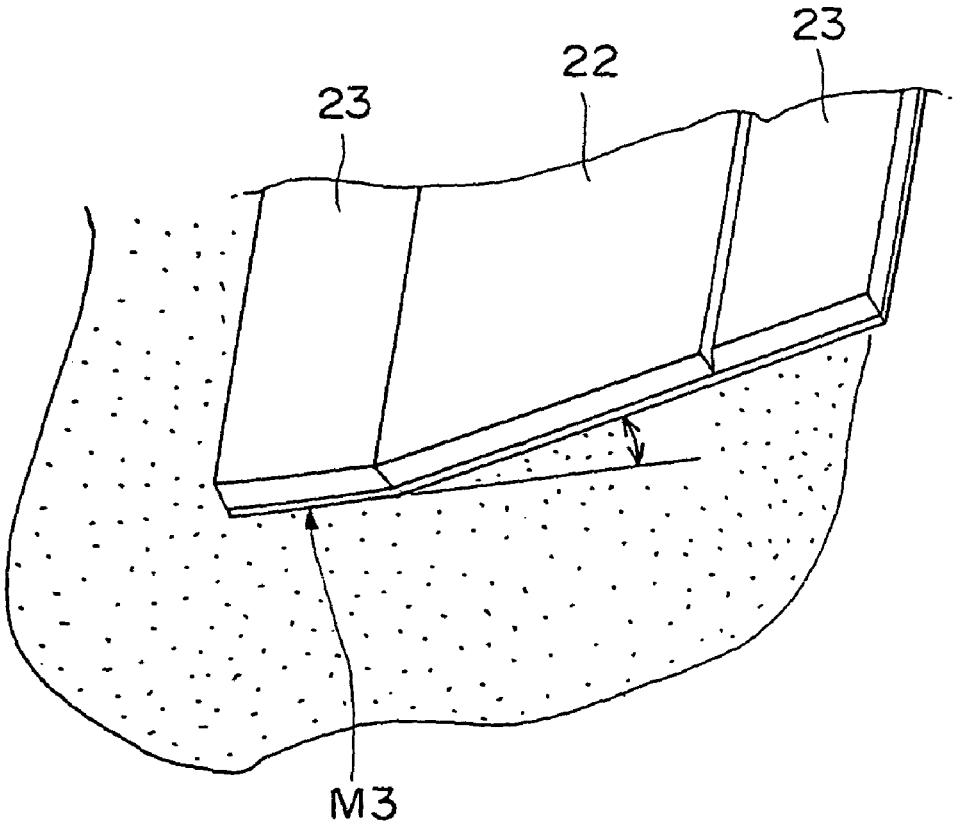
FIG. 10 is a perspective view showing how the movable base panel portion of a polishing device according to the present invention is movable.

As shown in FIG. 7, each of the base panel portion 22 and the movable base panel portions 23 arranged on the lower surface side of the retaining panel 21 consists of a rectangular thin-walled resin plate and is supported by the lower surface of the retaining panel 21 through the intermediation of elastic members 24. Further, the polishing surfaces M of the base panel portion 22 and the movable base panel portions 23 are arranged in the same plane by the elastic members 24, and a single adhesive sheet M1 is attached to the polishing surfaces M (See FIG. 8).

That is, the movable base panel portions 23 are bendably connected to the end portions 22*a* of the base panel portion 22 through the adhesive sheet M1, and are movable from the positions where they are flush with the base panel portion 22 to the positions where they come into contact with the end portions 21*a* of the retaining panel 21. The movable base panel portions 23 and the base panel portion 22 are connected to each other at their longer sides. The adhesive sheet M1 serves to facilitate the attachment and detachment of the sandpaper S.

While in this embodiment the base panel portion 22 and the movable base panel portions 23 are connected to each other by means of the adhesive sheet M1, it is also possible to form the base panel portion 22 and the movable base panel portions 23 of a single thin-walled resin plate and to form thin-walled flange portions in correspondence with the boundaries between the base panel portion 22 and the movable base panel portions 23 so as to make the movable base panel portions 23 bendable.

Figure 11:
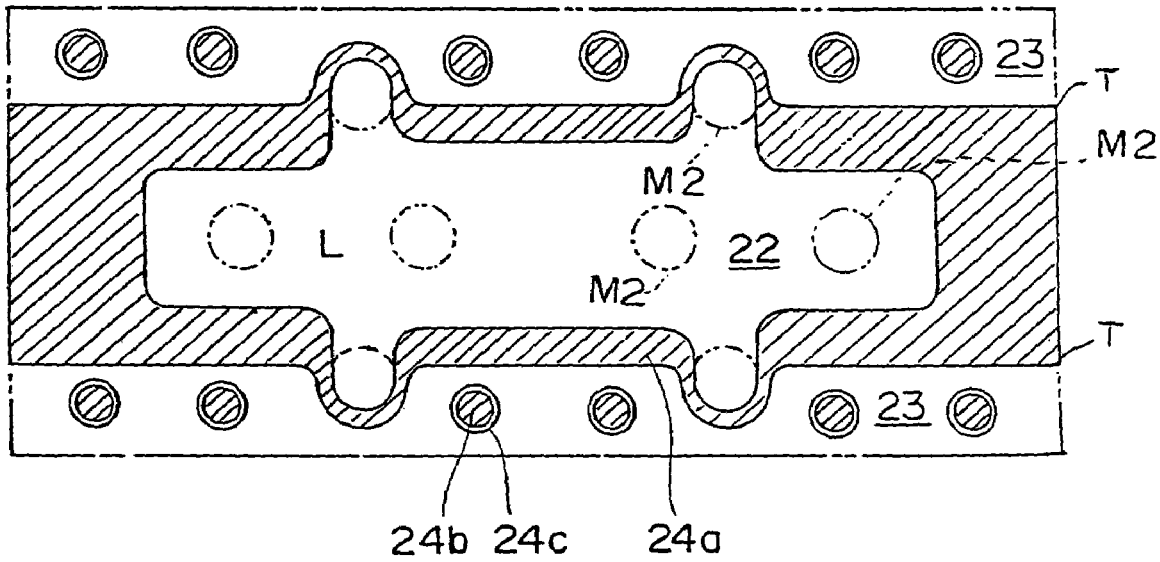
FIG. 11 is a diagram showing an elastic member in a polishing device according to the present invention.

As shown in FIG. 11, the elastic members 24 for fixing the base panel portion 22 and the movable base panel portions 23 to the retaining panel 21 consist of a first elastic support portion 24*a* which is made of hard sponge and which is provided so as to be erect along the periphery of the base panel portion 23 and adapted to support the base panel portion 23 on the retaining panel 21, and a plurality of second elastic support portions 24*b* which are provided on the movable base panel portions 23 and formed of hard sponge and springs 24*c* and which are adapted to support the movable base panel portions 23 on the retaining panel 21.

The first elastic support portion 24*a*, which is formed along the periphery of the base panel portion 22, forms between the retaining panel 21 and the base panel portion 22 an inner space L separated from the exterior. In view of this, in the polishing device 1 of this embodiment, the above-mentioned dust suction passage R is formed in the polishing panel body 2 by utilizing this inner space L. More specifically, the dust collection holes 21*c* of the retaining panel 21 are formed so as to communicate with the inner space L. Further, dust suction holes M2 communicating with the inner space L are also formed in the polishing surface M formed by the base panel portion 22 and the movable panel portions 23, forming in the polishing panel body 2 the dust suction passage R consisting of the dust suction holes M2, the inner space L, and the dust collection holes 21*c* (See FIG. 1).

As indicated by the imaginary lines in FIG. 11, the dust suction holes M2 formed in the polishing surface M are formed not only on the base panel portion, but also on the boundaries T between the movable base panel portions 23 and the base panel portion 22. Thus, a part of the first elastic support portion 24*a* protrudes on the movable base panel portion 23 side so as to go around the dust suction holes M2 provided on the boundaries T so that dust generated in the boundaries T can also be guided to the dust suction passage R. The dust suction passage R is connected to the dust suction device (not shown) by way of a dust suction passage R1 provided in the holding part 3 described below. The dust suction passage R1 will be described in detail below together with the holding part 3. As the dust suction device, a general-purpose dust suction device having a suction source is used.

In this way, in the polishing panel body 2, the end portions M3 of the polishing surface M formed by the movable base panel portions 23 are provided so as to be bendable. Thus, even when polishing is performed using the polishing surface end portion M3, the polishing surface end portion M3 comes into plane contact with the surface to be repaired. As a result, a satisfactory repaired surface can be easily obtained without involving overpolishing. Examples of a polishing operation using the polishing surface end portion M3 include a feather edge operation for imparting a gentle inclination from the vehicle panel surface to the former coated surface.

Next, the holding part 3 will be described.

As shown in FIG. 1, the holding part 3 includes a hollow holding part main body 31 held during use, a lock mechanism 32 accommodated in the holding part main body 31 and adapted to fix the holding part 3 at a predetermined rotating position with respect to the polishing panel body 2, and an axle 33 for mounting the holding part main body 31 rotatably to the polishing panel body 2.

The holding part main body 31 includes a swollen portion 34 to be brought into plane contact with the palm of the hand of the user, and finger rest recesses 35 provided on either side of the swollen portion 34 and held by fingers of the user during use, and generally exhibits a round outward appearance formed by continuous curved surfaces. In the state in which the holding part 3 and the polishing panel body 2 are connected together, the swollen portion 34 is situated at a position spaced apart from the center of the polishing panel body 2. And, inside the swollen portion 34, there are provided the above-mentioned lock mechanism 32 and a bearing 33*a* for the axle 33.

That is, the holding part 3 has a configuration which provides the most stable holding state when held so as to be wrapped in the entire hand of the user. As a result, a uniform pressure is generated with respect to the entire polishing surface M, whereby premature wear of the sandpaper S and disturbance of the smoothness of the non-polished surface can be restrained. Further, the external force (pressure) transmitted to the polishing surface M from the holding part 3 during operation of the polishing device 1 is transmitted at a point near the polishing surface M. Thus, shake of the polishing panel body 2 is restrained to thereby improve the operability of the polishing device 1. Further, since the portions coming into contact with the hand of the user are formed by continuous curved surfaces conformable to the hand, it is possible to prevent a pain and fatigue in the palm of the hand.

The bearing portion 33*a* fixes and supports the holding part main body 31 and the axle 33 at the center of the holding part main body 31. The axle 33 is inserted into the holding part support hole 21*a* provided in the retaining panel 21, and then fixed by a screw from the polishing surface M side of the base panel portion 22 through the intermediation of the base panel portion 22. A screw 33*b* is fastened with a fastening torque which allows the base panel portion 22 to easily rotate between the end surface of the axle 33 and the screw 33*b*. Thus, the axle 33 rotates within the holding part support hole 21*a*, permitting the holding part main body 31 to rotate with respect to the polishing panel body 2.

Further, in the surface of the holding part main body 31 coming into contact with the retaining panel 21, there is formed the dust suction passage R1 that the dust collection holes 21*c* provided in the retaining panel 21 face inwardly. The dust suction passage R1 can be connected to the dust suction device provided separately from the polishing device 1 through a hose P. In order that the dust suction passage R1 may constantly communicate with the plurality of dust collection holes 21*c* provided in the retaining panel 21 so as to be aligned in the center line of the retaining panel 21 even during rotation of the holding part 3, the width of the dust suction passage R1 formed in the holding part main body 31 is sufficiently larger than the width of the dust collection holes 21*c*.

On the other hand, as shown in FIG. 1, the lock mechanism 32 accommodated in the holding part main body 31 fixes the polishing panel body 2 and the holding part 3 at a position spaced apart from the rotation center (the axle 33) of the holding part main body 31.

Figure 12:
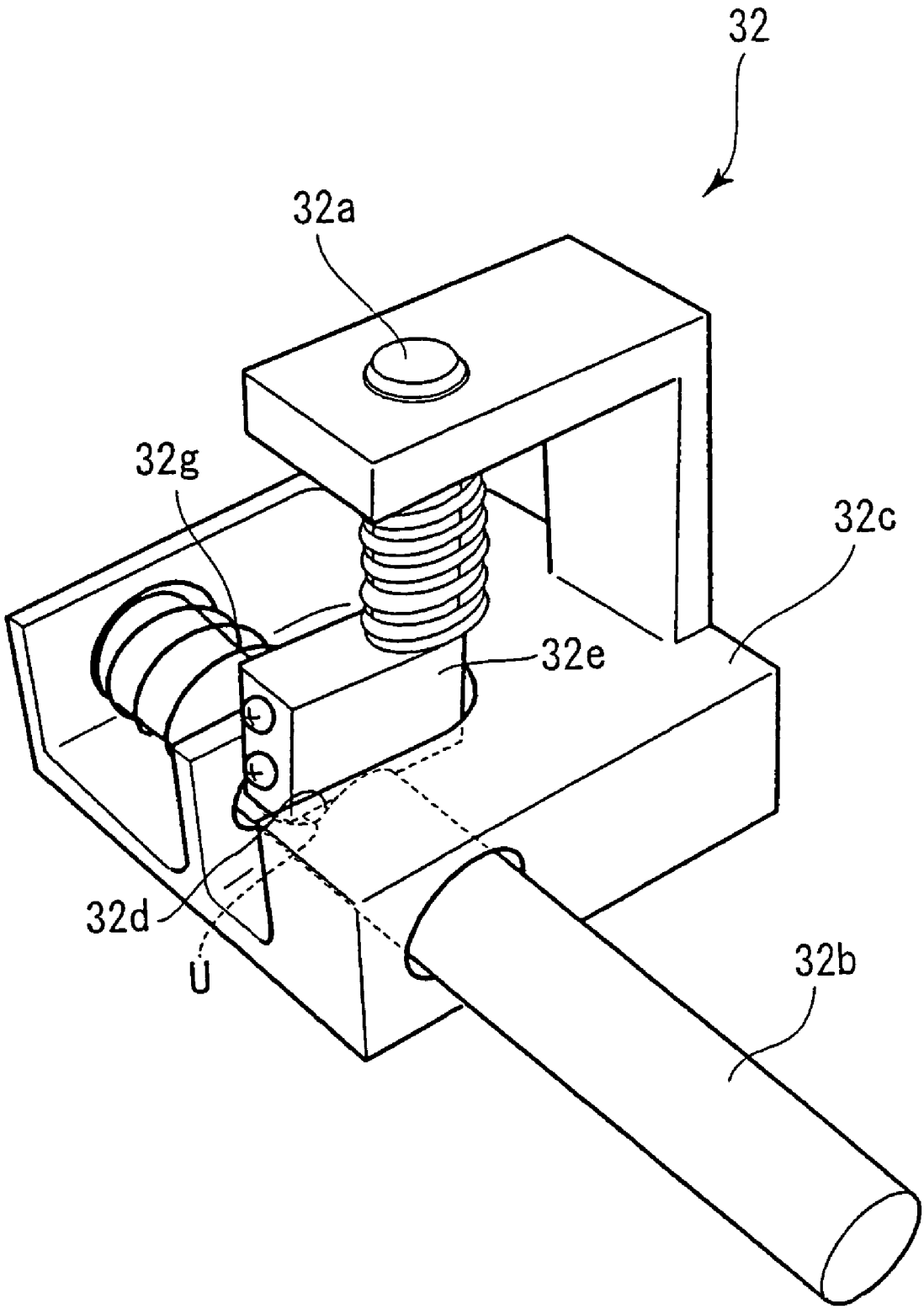
FIG. 12 is a perspective view showing a lock mechanism in a polishing device according to the present invention.
Figure 13:
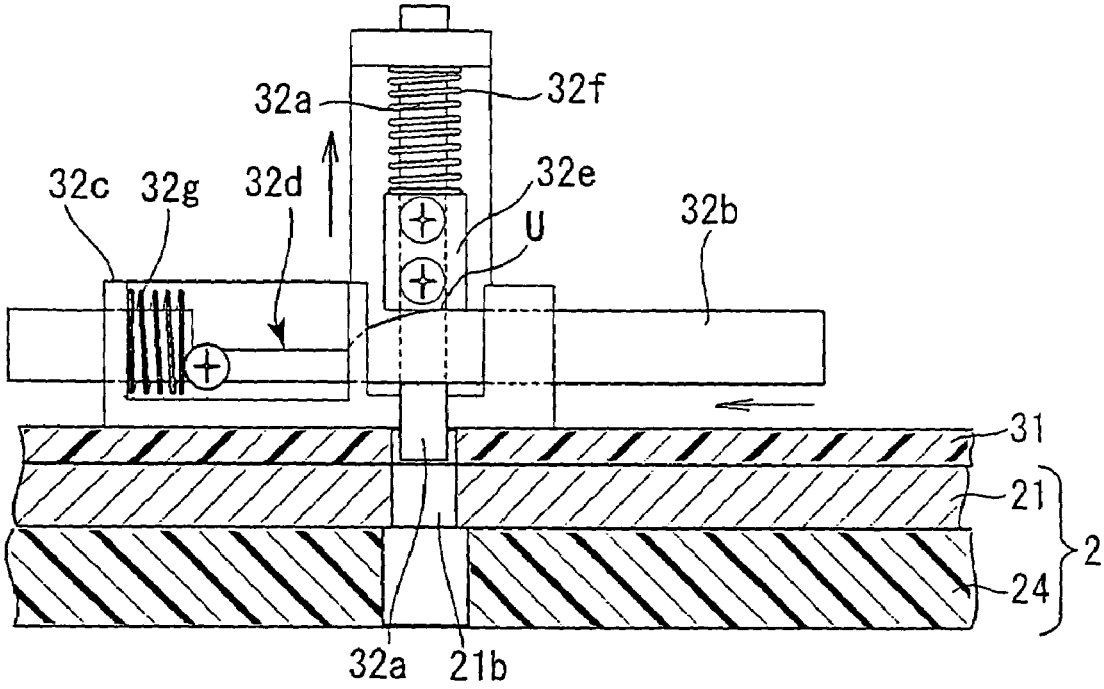
FIG. 13 is a diagram showing the movement of each component in the lock mechanism of FIG. 12 in a lock releasing state.

As shown in FIG. 12, this lock mechanism 32 includes a lock pin 32*a* (lock member) provided so as to be movable in the vertical direction of the holding part main body 31 and extending through the lower surface of the holding part main body 31 to be engaged with the lock hole 21*b* provided in the retaining panel 21, an operation rod 32*b* extending in the horizontal direction of the holding part main body 31 so as to have its forward end protruded to the exterior of the holding part main body 31 and capable of canceling the engagement of the lock pin 32*a* and the lock hole 21*b*, and a support body 32*c* supporting the lock pin 32*a* and the operation rod 32*b*.

That is, the lock pin 32*a* and the operation rod 32*b* are supported by the support body 32*c* so as to cross each other. Further, in the portion where the lock pin 32*a* and the operation rod 32*b* cross each other, there is provided a guide mechanism composed of a guide groove 32*d* and a guide member 32*e* and adapted to push the lock pin 32*a* upwards when the operation rod 32*b* is operated.

This guide mechanism will be described. The guide groove 32*d* is provided on the operation rod 32*b* side, and configured such that its depth decreases as the operation rod 32*b* is pushed in the support body 32*c*. The guide member 32*e* is fixed to the lock pin 32*a*, and is urged toward the interior of the guide groove 32*d* by a spring 32*f* so as to constantly maintain the engagement with the guide groove 32*d*.

Figure 14:
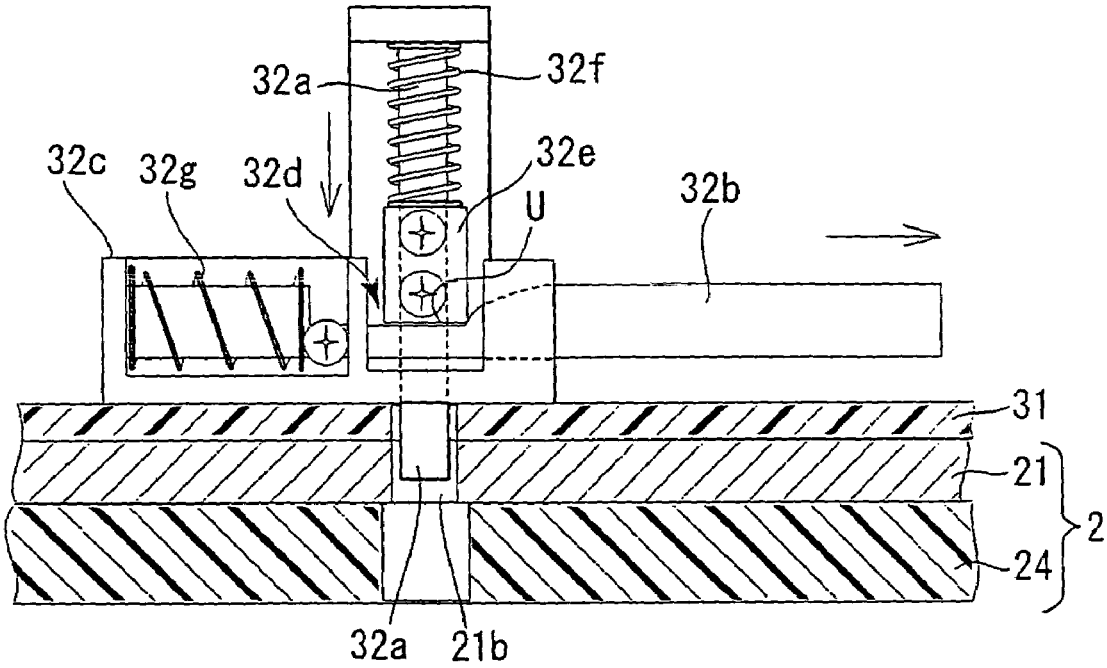
FIG. 14 is a diagram showing the movement of each component in the lock mechanism of FIG. 12 in a locking state.

Thus, when the operation rod 32*b* is pushed in the support body 32*c* as shown in FIG. 14, a portion U in contact with the guide member 32*e* and the guide groove 32*d* moves upwards within the guide groove 32*d*, which causes the lock pin 32*a* to slide upwards. Thus, the engagement of the lock pin 32*a* and the lock hole 21*b* is canceled, making it possible to rotate the holding part 3.

In the normal state, the operation rod 32*b* is urged by a spring 32*g* so as to protrude to the exterior of the support body 32*c*. Here, the "normal state" means the state in which the operation rod 32*b* is not being operated. Thus, when the operation of the operation rod 32*b* is stopped, the portion U in contact with the guide member 32*e* and the guide groove 32*d* moves downwards within the guide groove 32*d* (See FIG. 14), which causes the lock pin 32*a* to protrude to the retaining panel 21 side. Thus, the lock pin 32*a* and the lock hole 21*b* are engaged with each other to regulate the rotation of the holding part 3.

In a state in which the lock pin 32*a* and the lock hole 21*b* cannot be engaged with each other, when the operation of the operation rod 32*b* is stopped, the lock pin 32*a* is maintained in a state in which it is in contact with the panel face portion of the retaining panel 21. And, when the holding part 3 is rotated to the position where the lock pin 32*a* and the lock hole 21*b* are matched with each other, the lock pin 32*a* is automatically engaged with the lock hole 21*b* due to the tension of the spring 32*f*. That is, solely by pushing the operation rod 32*b* into the holding part main body 31, the lock state is canceled. When the operation of the operation rod 32*b* is stopped while rotating the holding part main body 31 with respect to the polishing panel body 2, locking is automatically effected at the nearest lock position (the lock hole 21*b*).

In this way, in the polishing device 1 of the present invention, the mounting angle of the holding part 3 with respect to the polishing panel body 2 can be arbitrarily changed as desired by the operator. Thus, it is possible to perform polishing operation without having to hold the device in an irregular fashion. Further, due to the provision of the lock mechanism 32 which allows the polishing panel body 2 and the holding part 3 to be easily fixed at a predetermined rotating position, the mounting angle of the holding part 3 with respect to the polishing panel body 2 can be changed through an easy operation.

While in the above embodiment the polishing panel body 2 has bendably formed polishing surface end portions M3, it is naturally also possible to adopt a general-purpose polishing panel body in which the polishing surface M is formed of a flat plate. Further, while the holding part 3 of the above embodiment has a generally round configuration, the configuration of the holding part 3 is not restricted to the above-described one.

SECOND EMBODIMENT

Next, as a preferred embodiment of the polishing device of the present invention, a two-hand polishing device 1A to be held by both hands when in use will be described. Since the construction of the polishing panel body 2 and the holding part 3 is the same as that of the above-described one-hand polishing device 1, the description will be focused on the differences. The components which are the same as those of the first embodiment are indicated by the same reference numerals.

Figure 15:
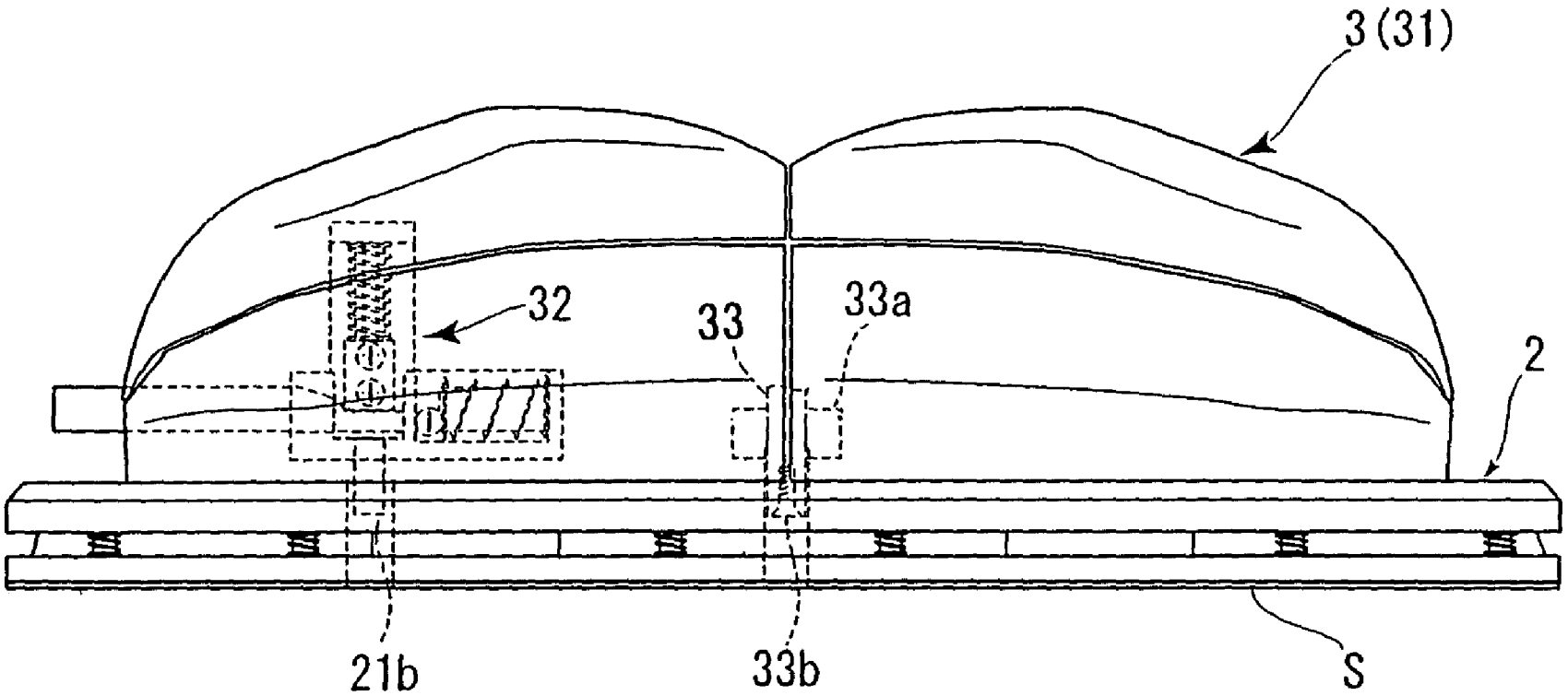
FIG. 15 is a side view of a two-hand polishing device according to a second embodiment of the present invention.
Figure 16:
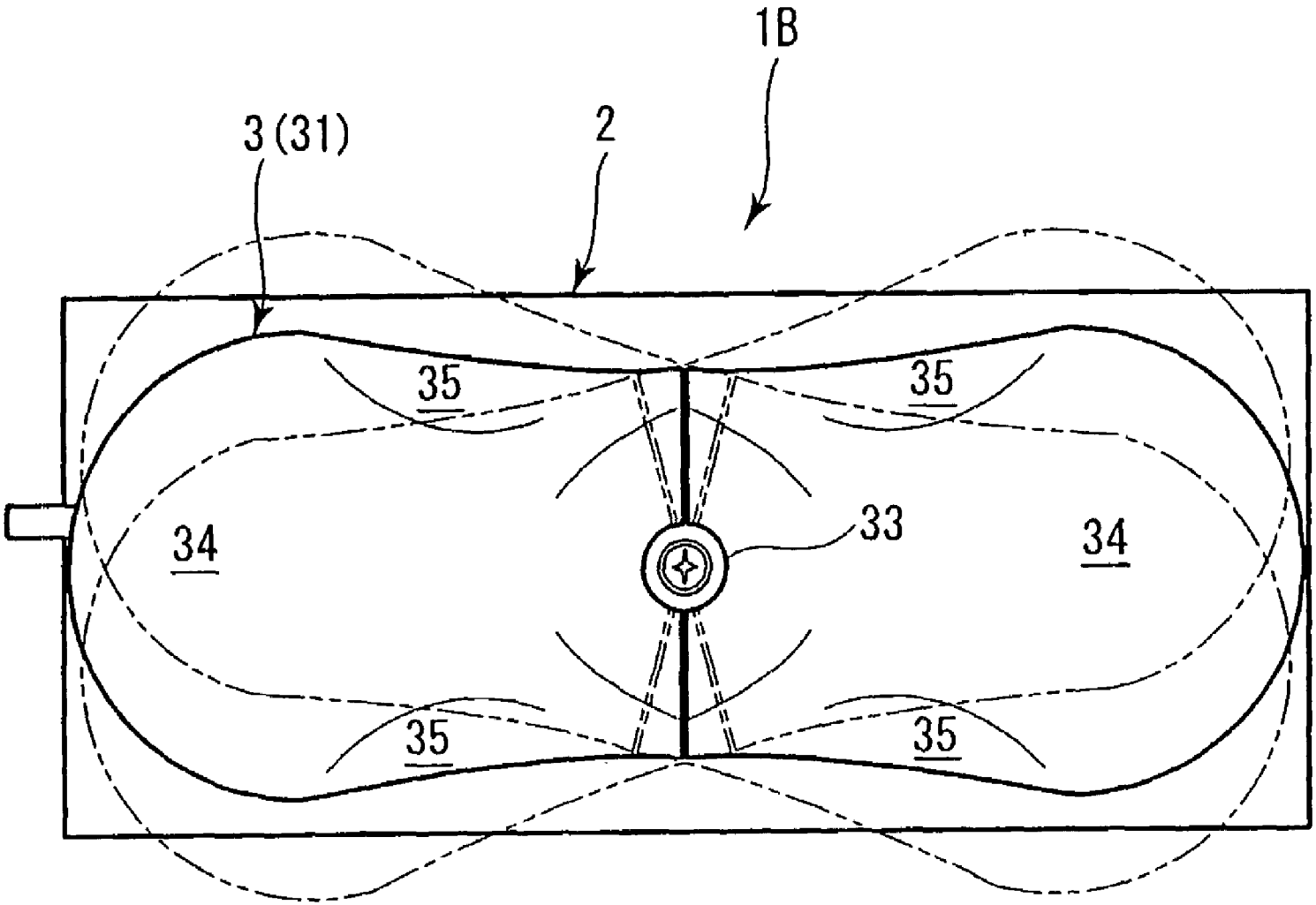
FIG. 16 is a plan view of the two-hand polishing device of the second embodiment of the present invention.

As shown in FIG. 15, the two-hand polishing device 1A differs from the one-hand polishing device 1 in the size and configuration of the holding part main body 31A. More specifically, swollen portions 34 coming into plane contact with the palm of the hand of the user are arranged in a straight line passing the axle 33 so as to be symmetrical with respect to the axle 33. That is, the swollen portion 34 is formed at either end of the holding part 3. Further, as in the one-hand polishing device 1, the finger rest recess 35 is formed on either side of each swollen portion 34. That is, the device is configured such that it provides the most stable holding state when the holding part 3 is held by both hands so as to be wrapped from both sides.

The lock mechanism 32 may be contained in one of the two swollen portions 34. As in the above one-hand polishing device 1, the engagement of the lock pin 32*a* and the lock hole 21*b* is canceled when the operation rod 32*b* is operated, permitting the holding part 3 to rotate. When the operation of the operation rod 32*b* is stopped, the lock mechanism 32 is placed in the locking state again.

THIRD EMBODIMENT

Figure 17:
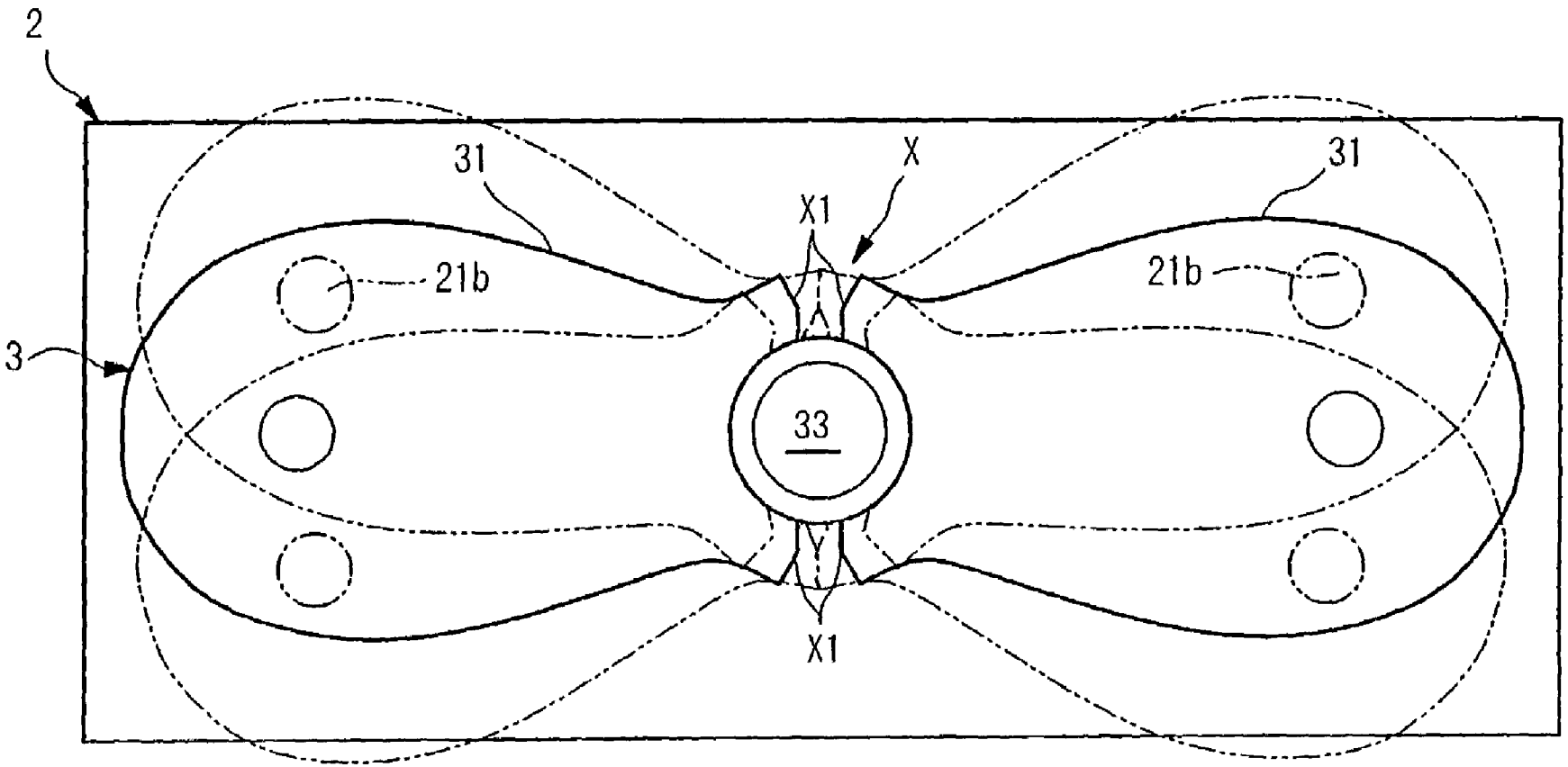
FIG. 17 is a plan view of a two-hand polishing device according to a third embodiment of the present invention.

Next, as a modification of the above two-hand polishing device 1A, a polishing device 1B in which each swollen portion 34 can independently rotate will be described with reference to FIG. 17. The polishing device 1B described below has substantially the same construction as that of the one-hand polishing device 1 and the two-hand polishing device 1A, so that the description will be focused on the differences. The components which are common to the first, second, and third embodiments are indicated by the same reference numerals, and a description of such components will be abridged.

In this embodiment, the swollen portions 34 arranged in a straight line passing the axle 33 in the second embodiment can independently rotate. That is, while in the two-hand polishing device 1A the swollen portions 34 are arranged in a straight line on either side of the axle 33, the swollen portions 34 of this embodiment can independently rotate around the axle 33.

More specifically, the holding part 3 is formed of two mutually independent holding part main bodies 31, each of which is supported so as to be rotatable on the axle 33. While in the first and second embodiments the axle 33 and the holding part main body 31 are fixed together, in this embodiment, the axle 33 is fixed to the polishing panel body 2 side, each holding part main body 31 being connected so as to be rotatable on the axle 33.

Further, in the connecting portion X where each holding part main body 31 is connected to the axle 33, there are provided cutouts (clearances) X1 in order to avoid interference with the other holding part main body 31 in the case of rotation in the same direction. Due to these cutouts X1 serving as clearances, the holding part as a whole can assume a V-shaped or a reverse V-shaped pattern.

Further, each holding part main body 31 is provided with the lock mechanism 32 as described above, and on the retaining panel 21 side there are provided a plurality of sets of lock holes 21*b* in correspondence with the lock pins 32*a* of the lock mechanisms 32. Thus, each holding part main body 31 can be fixed at an arbitrary rotating position.

In this way, in the polishing device 1B of this embodiment, the degree of freedom in terms of the holding angle for the holding part 3 is further increased as compared with the above-described two-hand polishing device 1A, making it possible to further improve the operability of the polishing device 1.

Next, an example of the operation method for the one-hand polishing device 1 of the present invention will be described. It is to be noted that the following operation method is only illustrated by way of example, and the operation method for the polishing device 1 of the present invention is not restricted thereto.

First, prior to the description of a specific operation method, an ideal polishing operation which puts no great strain on the operator will be described. A precondition for an ideal polishing operation allowing the operator to perform polishing without experiencing any fatigue is that in the condition in which the holding part 3 is held, the forearm and the back of the hand are arranged in a straight line. That is, in such a polishing operation, no unnecessary load is applied to the wrist when the arm makes a reciprocating movement in the polishing direction.

Figure 18:
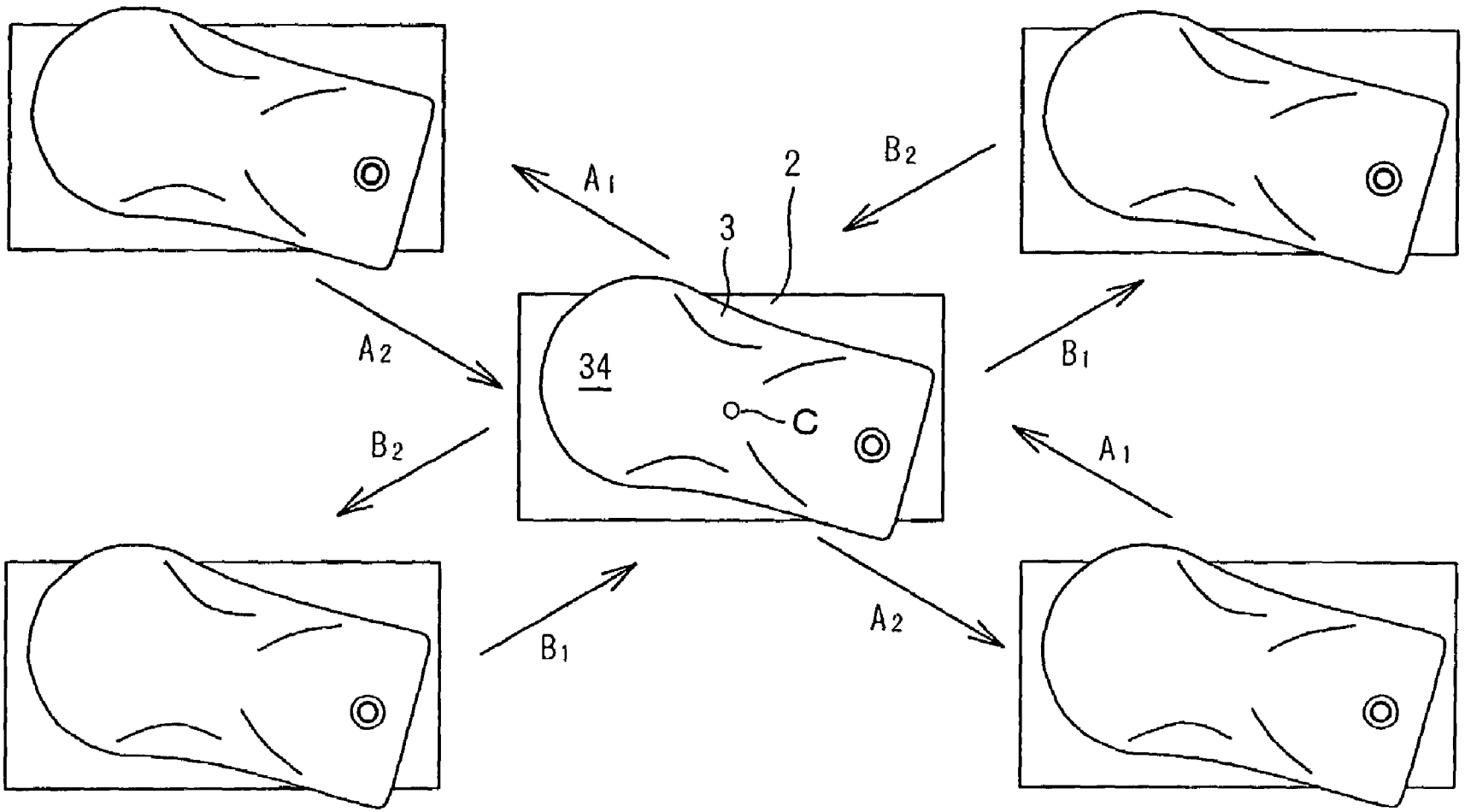
FIG. 18 is a diagram showing the fixing angle of the holding part when the polishing device of the first embodiment is operated obliquely with the right hand.
Figure 19:
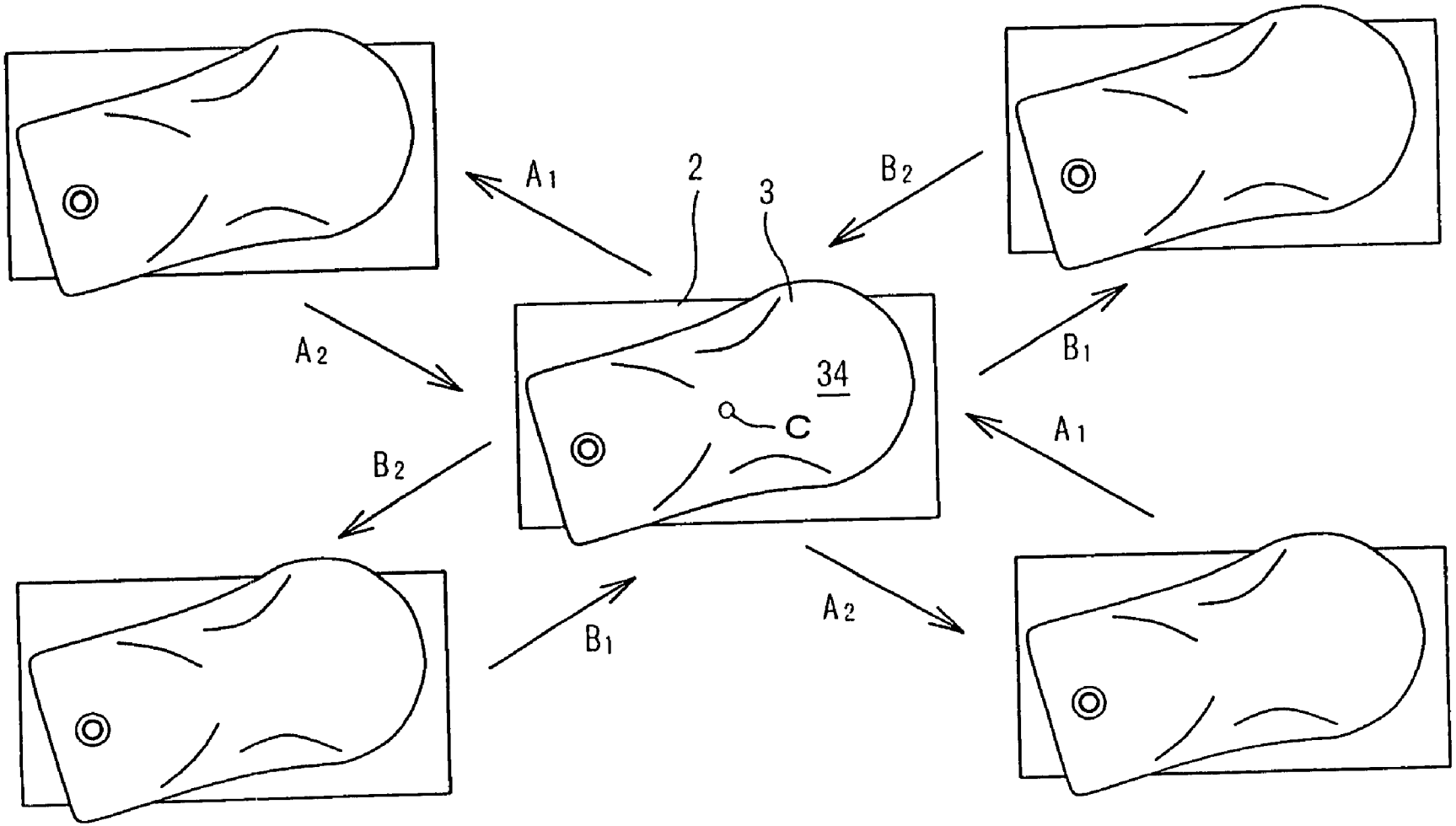
FIG. 19 is a diagram showing the fixing angle of the holding part when the polishing device of the first embodiment is operated obliquely with the left hand.
Figure 20:
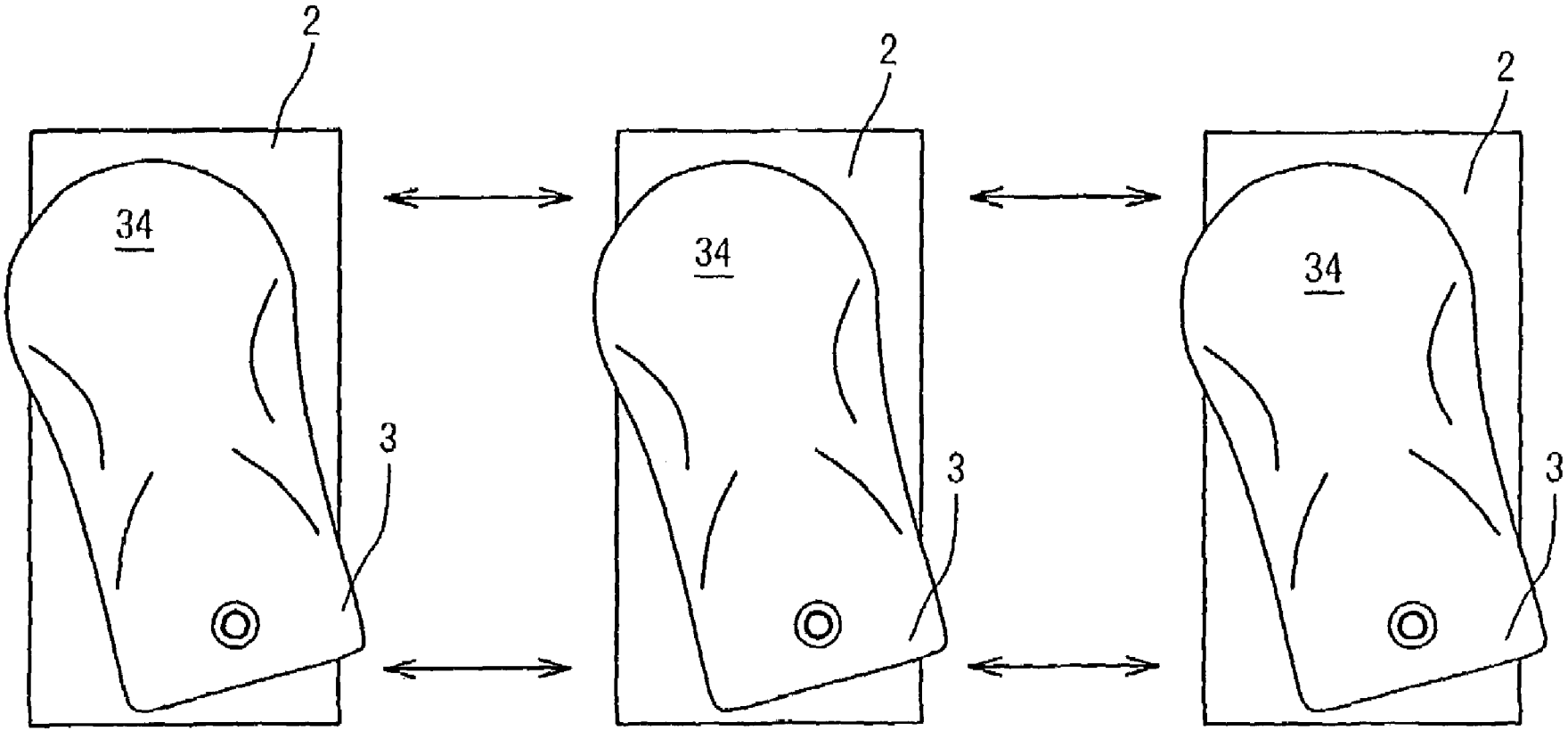
FIG. 20 is a diagram showing the fixing angle of the holding part when the polishing device of the first embodiment is operated horizontally with the right hand.
Figure 21:
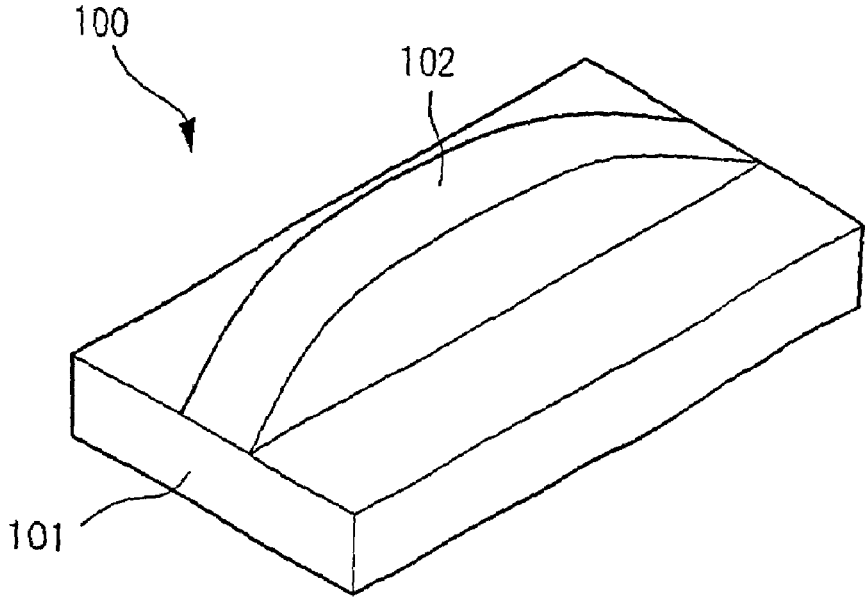
FIG. 21 is a perspective view showing a conventional polishing device.
Figure 22:
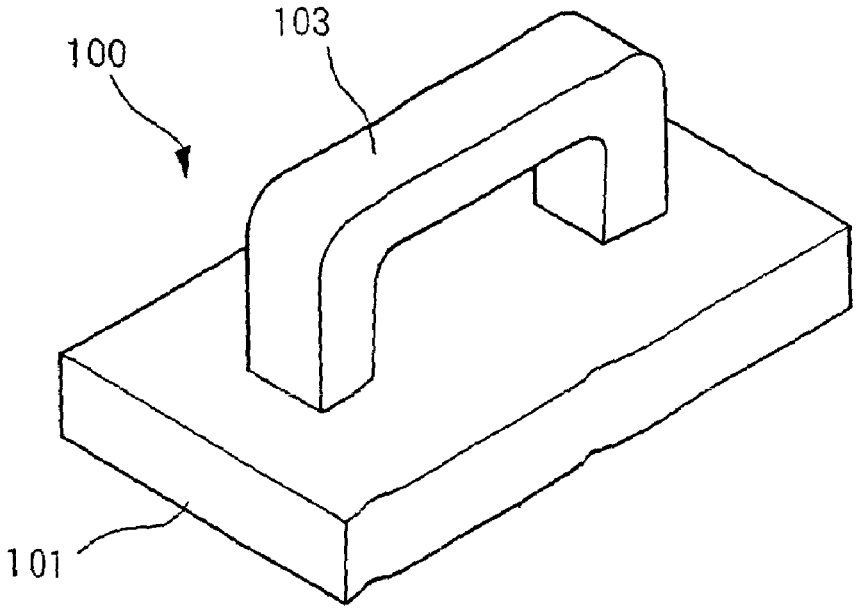
FIG. 22 is a perspective view showing a conventional polishing device.

In view of this, in the following example of the preferred operation method, the above precondition is taken into account. FIG. 18 shows the fixing angle of the holding part 3 when the polishing device 1 is moved obliquely, with the holding part 3 held by the right hand. FIG. 19 shows the fixing angle of the holding part 3 when the polishing device 1 is moved obliquely, with the holding part 3 held by the left hand. FIG. 20 shows the fixing angle when the polishing device 1 is held by the right hand and moved horizontally.

First, with reference to FIG. 18, an oblique polishing operation using the right hand will be described. In this polishing operation, it is recommended that the holding part 3 be fixed, with the swollen portion 34 of the holding part main body 31 being positioned on the front and left side with respect to the front side of the polishing panel body 2, i.e., the upper side as seen in the drawing.

In this case, since the operator performs the operation with the right hand, the elbow is situated on the right-hand side of the polishing operation center C. Thus, when the holding part 3 is held in this state, the back of the hand and the forearm are aligned in a straight line, making it possible to hold the holding part 3 in a natural fashion. As a result, the operability is markedly improved especially in the directions indicated by arrows A1 and A2. Further, also in polishing in the directions of arrows B1 and B2, the twisting of the wrist can be reduced to a minimum, making it possible to perform operation mainly through horizontal movement of the forearm alone. Thus, there is no need to perform polishing operation at an unreasonable holding angle as in the case of an existing polishing device, enabling the user to perform the polishing operation very easily.

Next, the polishing operation with the left hand will be described with reference to FIG. 19.

In this polishing operation, it is recommended that the holding part 3 be fixed, with the maximum swollen portion 34*a* of the holding part main body 31 being positioned on the front and right side with respect to the front side of the polishing panel body 2, i.e., the upper side as seen in the drawing.

In this case, since the operation is performed with the left hand, the elbow is situated on the left-hand side of the polishing operation center C. Thus, when the holding part 3 is held in this state, the back of the hand and the forearm are aligned in a straight line, making it possible to hold the holding part 3 in a natural fashion. As a result, the operability is markedly improved especially in the directions indicated by the arrows B1 and B2. Further, also in polishing in the directions of the arrows A1 and A2, the twisting of the wrist can be reduced to a minimum, making it possible to perform operation mainly through movement of the forearm alone.

Next, a polishing operation in which polishing is performed while horizontally reciprocating the polishing device with the right hand will be described with reference to FIG. 20.

In this polishing operation, it is recommended that the holding part 3 is fixed, with the maximum swollen portion 34*a* of the holding part main body 31 being positioned on the front and left side with respect to the front side of the polishing panel body 2, i.e., the upper side as seen in the drawing.

In this case also, as in the above examples of the operation method, the back of the hand and the forearm are aligned in a straight line, making it possible to hold the holding part 3 in a natural fashion. As a result, while with an existing polishing device (the left-hand side in the drawing) it is necessary to twist the wrist greatly at the left end of the surface to be repaired (the left-hand side in the drawing), the polishing device 1 of the present invention allows operation mainly through horizontal movement of the forearm alone. Thus, the user is enabled to perform polishing operation easily without experiencing any fatigue or pain in the wrist.

The above-described embodiments of the present invention should not be construed restrictively. Various modifications are possible for those skilled in the art without departing from the gist of the invention as claimed.

The invention claimed is:

1. A polishing device, comprising: a polishing panel body which holds a polishing material on its surface opposed to a surface to be repaired and which polishes the surface to be repaired into a predetermined shape with the polishing material; a holding part which is provided on the polishing panel body and which is held by hand when the polishing panel body is to be operated; and fixing means for fixing the holding part at any one of a number of predetermined, operative rotating positions with respect to the polishing panel body, characterized in that the holding part is provided on the polishing panel body so as to be rotatable about an axis set on the polishing panel body, and the fixing means fixes the polishing panel body and the holding part to each other at a position spaced apart from a rotation center of the holding part.

2. A polishing device according to claim 1, characterized in that the holding part is rotatably provided in a plane parallel to a panel surface of the polishing panel body.

3. A polishing device according to claim 1, characterized in that the fixing means comprises a lock member which can freely move to a lock position where the polishing panel body and the holding part are normally fixed to each other and a lock releasing position where the fixation of the polishing panel body and the holding part is canceled to permit rotation of the holding part.

4. A polishing device according to claim 1, characterized in that the holding part comprises a swollen portion whose surface comes into contact with the palm of the hand during operation of the polishing device, and finger rest recesses arranged on both sides of the swollen portion and held between fingers during the operation of the polishing device.

5. A polishing device according to claim 4, characterized in that connecting portions between the swollen portion and the finger rest recesses are formed as continuous curved surfaces.

6. A polishing device according to claim 4, characterized in that the swollen portion is provided at a position spaced apart from a center of the polishing panel body.

7. A polishing device according to claim 4, characterized in that the holding part is equipped with a plurality of the swollen portions, and at least two of the plurality of the swollen portions are arranged in a straight line passing the axis so as to be symmetrical with respect to the axis.

8. A polishing device according to claim 1, characterized in that the holding part is composed of a plurality of members each being equipped with a swollen portion including a surface which contacts the palm of a hand during operation of the polishing device and each of the members is provided so as to be rotatable with respect to the axis.

9. A polishing device according to claim 1, characterized in that the polishing panel body is characterized by comprising:

a base panel portion retaining a polishing material on its surface opposed to a surface to be repaired;

a movable base panel portion bendably hinged on an end portion of the base panel portion and retaining a polishing material on its surface opposed to the surface to be repaired; and an urging means for urging the surface of the movable base panel portion so as to make it flush with the surface of the base panel portion.

10. A polishing device according to claim 1, characterized in that the fixing means comprises a plurality of locking holes.

11. A polishing device according to claim 10, characterized in that the locking holes are arranged along a radius of curvature, the center of which coincides with a rotation axis of the holding part.

12. A polishing device according to claim 10, characterized in that the fixing means further comprises a locking pin for engaging the locking holes, and a one touch release mechanism for disengaging the locking pin from the locking holes.

13. A polishing device according to claim 1, characterized in that the holding part has at least three predetermined, operative rotating positions.

* * * * *